United States Patent [19]

Iwamoto

[11] 4,318,358

[45] Mar. 9, 1982

[54] PRESSER FOOT

[76] Inventor: Kenichi Iwamoto, No. 2283, Daishuku-cho, Sano City, Tochigi Prefecture, Japan

[21] Appl. No.: 88,647

[22] Filed: Oct. 26, 1979

[30] Foreign Application Priority Data

Oct. 30, 1978 [JP] Japan ..... 53/148164[U]
Mar. 14, 1979 [JP] Japan ..... 54/32481[U]

[51] Int. Cl.[3] ..... D05B 29/08
[52] U.S. Cl. ..... 112/235
[58] Field of Search ..... 112/235, 60, 61

[56] References Cited

U.S. PATENT DOCUMENTS

| | | | |
|---|---|---|---|
| 94,812 | 9/1869 | Contessa | 112/235 X |
| 1,820,829 | 8/1931 | Ray | 112/235 X |
| 1,823,546 | 9/1931 | Johnson | 112/235 |
| 1,927,601 | 9/1933 | Willis | 112/235 |

FOREIGN PATENT DOCUMENTS

| | | | |
|---|---|---|---|
| 1362055 | 7/1974 | United Kingdom | 112/235 |
| 2034777 | 6/1980 | United Kingdom | 112/235 |

*Primary Examiner*—Werner H. Schroeder
*Assistant Examiner*—Andrew M. Falik
*Attorney, Agent, or Firm*—Martin Smolowitz

[57] ABSTRACT

A presser foot assembly of a sewing machine, comprising a presser foot member having a bottom rib and a bottom surface both extending in fore-and-aft directions of the presser foot member and a flexible annular band fitted to the presser foot member in such a manner that the inner peripheral surface of the annular band is circumferentially slidable in a fore-and-aft direction of the presser foot member, wherein one of the presser foot member and the annular band is formed with a groove and the other thereof is formed with a projection slidable through the groove for maintaining the slidable engagement between the presser foot member and the annular band.

44 Claims, 14 Drawing Figures

PRESSER FOOT

FIELD OF THE INVENTION

The present invention relates to sewing machines and more particularly to a presser foot assembly of a sewing machine.

BACKGROUND OF THE INVENTION

When in sewing together webs of, for example, textile fabrics by a sewing machine, it is sometimes experienced that the webs being intermittently fed underneath the presser foot member of the sewing machine are caused to slip on each other. The slip between the webs being sewn together usually results from the resistance imparted to the lower one of the webs by the feed dog member which is being driven for square motions underneath the webs and onto which the webs are pressed by the presser foot member. The slip thus caused between the webs being sewn together tends to produce crimps in the webs and destroy or at least impair the external appearance of the sewn product. Prevention of the slip between the webs being sewn together on a sewing machine has therefore been a matter of serious concern to users, especially unexperienced users, of sewing machines. The present invention contemplates provision of a presser foot assembly of a sewing machine which will enable even an unexperienced user of a sewing machine to sew webs without causing a slip between the webs.

SUMMARY OF THE INVENTION

In accordance with the present invention, there is provided a presser foot assembly of a sewing machine, comprising, in combination, a presser foot member having a substantially flat bottom surface extending in a fore-and-aft direction of the presser foot member and a bottom rib longitudinally extending adjacent the aforesaid bottom surface of the presser foot member, the presser foot member being formed with a needle hole which is downwardly open through the aforesaid rib, and a flexible annular band having a smooth inner peripheral surface circumferentially slidable on the bottom surface of the presser foot member in the aforesaid fore-and-aft direction, wherein one of the presser foot member and the annular band is formed with a groove extending at least in part in the above mentioned fore-and-aft direction and the other of the presser foot member and the annular band is formed with a projection slidably received in the aforesaid groove.

In one specific embodiment of the presser foot assembly thus constructed, the annular band has formed as the above mentioned groove a circumferential groove extending along the inner peripheral surface of the band. The presser foot member compatible with such an annular band has a first longitudinal rib extending along the inner peripheral surface of the band; and a second longitudinal rib extending along one side end of the presser foot member and laterally spaced apart substantially in parallel from the first longitudinal rib for thereby forming between the first and second longitudinal ribs an elongated groove having open longitudinal ends and an upper end defined by the aforesaid bottom surface of the presser foot member, wherein the second longitudinal rib constitutes the above mentioned projection and is slidable in the circumferential groove in the fore-and-aft direction of the presser foot member.

In another specific embodiment of the presser foot assembly according to the present invention, the presser foot member has a first longitudinal rib constituting the above mentioned bottom rib of the presser foot member and a second longitudinal rib extending along one side end of the presser foot member and having a lower surface portion constituting the above mentioned bottom surface of the presser foot member, the first and second longitudinal ribs being spaced apart substantially in parallel from each other for thereby forming the above mentioned groove therebetween by an elongated groove having open longitudinal ends, the aforesaid projection being formed on the inner peripheral surface of the annular band and being slidable through the elongated groove in the presser foot member in the aforesaid fore-and-aft direction of the presser foot member. In this instance, the projection of the annular band may be constituted by each of a series of radial projections formed on the inner peripheral surface of the annular band preferably at substantially regular intervals from each other circumferentially of the inner peripheral surface of the band.

In still another specific embodiment of the present invention, the above mentioned groove is constituted by an elongated groove which the presser foot member has formed in its side wall opposite to the bottom rib across the aforesaid bottom surface of the presser foot member and which extends in the fore-and-aft direction of the presser foot member and has open longitudinal ends, the aforesaid projection being formed adjacent one side end of the inner peripheral surface of the annular band and being slidable through the elongated groove in the presser foot member. In this instance, too, the above mentioned projection may be constituted by each of a series of radial projections formed on the inner peripheral surface of the annular band and preferably arranged at substantially regular intervals from each other throughout the inner circumference of the annular band.

In each of the embodiments of the presser foot assembly according to the present invention, the annular band preferably has a frictional layer attached to the outer peripheral surface of the band for increasing the coefficient of friction between the outer peripheral surface of the band and a web of, for example, textile cloth to be contacted by the annular band during sewing.

BRIEF DESCRIPTION OF THE DRAWINGS

The features and advantages of a presser foot assembly according to the present invention will be more clearly understood from the following description taken in conjunction with the accompanying drawings in which like reference numerals designate corresponding or similar members, elements or spaces and in which.

DESCRIPTION OF THE PREFERRED EMBODIMENTS

The preferred embodiments of a presser foot assembly according to the present invention will be hereinafter described with reference to the drawings.

Figure 1:
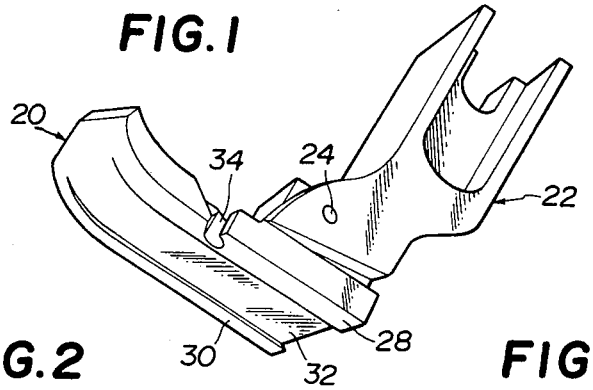
FIG. 1 is a perspective view showing part of a preferred embodiment of the present invention.
Figure 4:
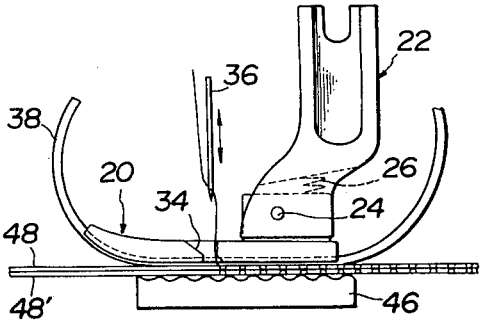
FIG. 4 is a side elevation view showing a condition in which the presser foot assembly including the presser foot member and the annular band illustrated in FIGS. 1 to 3 is in operation in a sewing machine.

Referring first to FIG. 1 of the drawings, a presser foot assembly embodying the present invention is shown comprising a unitary presser foot member 20 and a bracket 22 having the presser foot member 20 pivotally connected thereto by means of a pin 24. Though not shown in the drawings, the bracket 22 in turn is connected to the lower end of a vertical presser bar by adjustable fastening means so that the presser foot member 20 longitudinally extends generally in a fore-and-aft direction of a sewing machine as will be well known in the art. As will be also well known in the art, the bracket 22 and accordingly the presser foot member 20 are vertically movable upwardly and downwardly together with the presser bar. Furthermore, the presser foot member 20 is slightly turnable upwardly and downwardly with respect to the bracket 22 about the horizontal center axis of the pivot pin 24 and is biased to turn about the axis of the pin 24 in a direction to have its foremost end raised by suitable biasing means such as a helical compression spring (indicated by broken lines at 26 in FIG. 4) intervening between the presser foot member 20 and the bracket 22. Each of the presser foot member 20 and the bracket 22 is constructed of metal or a molded plastic member. The presser foot member 20, in particular, is preferably formed of Teflon (R.T.M.) or any other synthetic resin having a relatively low friction coefficient. Although, furthermore, the presser foot member 20 is herein shown to have an upwardly turned foremost end portion, such a configuration of the presser foot member 20 is not an essential feature of a presser foot assembly according to the present invention. Thus, a presser foot assembly according to the present invention may comprise a presser foot member which extends substantially straight in a fore-and-aft direction of a sewing machine or which is slightly curled up toward its foremost and rearmost ends, though not shown in the drawings.

The presser foot member 20 of the embodiment illustrated in FIG. 1 has as its bottom first and second longitudinal ribs 28 and 30 extending in longitudinal directions of the presser foot member 20 respectively along the opposite side ends of the presser foot member. The first and second longitudinal ribs 28 and 30 of the presser foot member 20 respectively have substantially flat lower surface portions longitudinally extending from the rearmost end of the presser foot member 50 toward the foremost end thereof. As will be seen more clearly from FIG. 2, the lower surface portion of the first longitudinal rib 28 is lower than the lower surface portion of the second longitudinal rib 30. The ribs 28 and 30 and accordingly the respective lower surface portions thereof are spaced apart substantially in parallel from each other in a lateral direction (which is perpendicular to the afore-and-aft direction of a sewing machine) of the presser foot member 20 so that an elongated groove 32 is formed between the ribs 28 and 30 and by a flat surface higher than the respective lower surface portions of the first and second longitudinal ribs 28 and 30. The first longitudinal rib 28 has an inner side face substantially perpendicular to the surface thus defining the elongated groove 32 in the presser foot member 10. On the other hand, the second longitudinal rib 30 has a generally dovetailed cross sectional configuration enlarged downwardly and, accordingly, has opposite side faces which are inclined away from each other toward their lower ends with respect to a vertical plane. The presser foot member 20 is further formed with a needle hole 34 which is vertically open at its lower end through the first longitudinal rib 28 of the presser foot member 20, viz., through the lower surface portion of the rib 28. The needle hole 34 is located in the presser foot member 20 in such a manner as to be vertically aligned with an eye-pointed sewing needle (indicated at 36 in FIG. 4) when the presser foot member 20 assumes a horizontal position about the center axis of the pivot pin 24. The needle hole 34 is shown to have an upper notch portion which is open upwardly in a foreward direction of the presser foot member 20 as is customary in the art.

Figure 2:
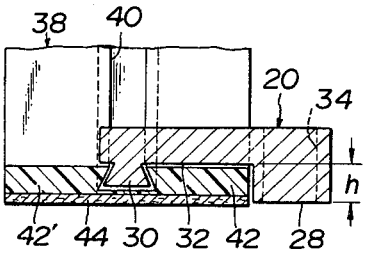
FIG. 2 is a cross sectional view showing the combination of the presser foot member shown in FIG. 1 and an annular band fitted to the presser foot member.
Figure 3:
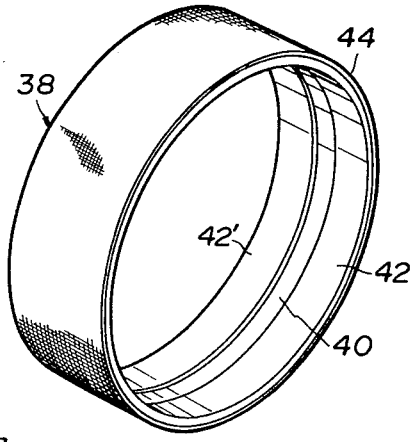
FIG. 3 is a perspective view showing the annular band which is shown in cross section in FIG. 2.

The presser foot assembly embodying the present invention further comprises a flexible and preferably elastic, annular band 38 having an inner peripheral wall formed with a circumferential groove 40 as shown in FIG. 3. The flexible annular band 38 thus formed with the circumferential groove 40 has two inner peripheral collar portions 42 and 42' spaced apart from each in the axial direction of the band 38 across the groove 40 and having smooth inner peripheral surfaces. The circumferential groove 40 in the annular band 38 substantially conforms in cross section to the second longitudinal rib 30 of the presser foot member 20 and, accordingly, has a generally dovetailed cross sectional configuration which is reduced in width toward the inner peripheral end of the groove 40. The annular band 38 thus configured is assembled to the presser foot member 20 in such a manner as to have the second longitudinal rib 30 of the presser foot member 20 slidably fitted in the groove 40 substantially throughout the length of the rib 30 and to have one of its inner peripheral collar portions such as for example the inner peripheral collar portion 42 slidably received on the surface defining the elongated groove 32 in the presser foot member 20 as shown in FIG. 2. The flexible annular band 38 is, thus, circumferentially slidable on the presser foot member 20 through the surface engagement of the band 38 with the lower surface portion of the second longitudinal rib 30 and the surface defining the groove 32 in the presser foot member 20. The annular band 38 has a thickness substantially equal to the height (indicated by h in FIG. 2) of the first longitudinal rib 28 with respect to the surface defining the groove 32 in the presser foot member 20. When the flexible annular band 38 is held in close contact with the lower surface portion of the second longitudinal rib 30 and the surface defining the groove 32 in the presser foot member 20, the outer peripheral surface of the band 38 is thus substantially flush with the lower surface of the first longitudinal rib 28 of the presser foot member 20 as will be seen from FIG. 2.

The flexible annular band 38 may be formed of polypropyrene or any other suitable synthetic resin having a relatively low friction coefficient. If desired, the annular band 38 formed of such a slippery material may be covered with a suitable frictional layer applied to the outer peripheral surface of the band 38 as indicated at 44 in FIGS. 2 and 3. Such a frictional layer may be formed by a web of leather or relatively thick textile fabric and lends itself to producing adequate sliding friction between the outer peripheral surface of the annular band 38 and a web of, for example, textile fabric to be contacted by the outer peripheral surface of the band 38 during sewing operation as will be described in more detail.

When the presser foot assembly thus constructed and arranged is assembled to the presser bar (not shown) of a sewing machine, the presser foot assembly is positioned and movable upwardly and downwardly over a throat plate attached, fixedly or detachably, to the arm bed of the sewing machine and formed with a slot elongated in a fore-and-aft direction of the sewing machine, though not shown in the drawings. A feed dog member (indicated at 46 in FIG. 4) having a toothed or corrugated upper end is movable back and forth and up and down through this slot in the throat plate and is engageable with the presser foot member 20 across webs of, for example, textile cloth (indicated at 48 and 48' in FIG. 4) positioned on the throat plate for being sewn together. The feed dog member 46 is driven concurrently for forward and backward and upward and downward motions by means of a four-motion or square-motion mechanism provided below the throat plate, as well known in the art.

When, now, the presser bar of the sewing machine thus constructed and arranged is moved downwardly with the webs 48 and 48' superposed on each other on the throat plate of the sewing machine, the presser foot assembly connected to the presser bar is also moved downwardly and as a consequence the presser foot member 20 of the assembly is brought into downwardly pressing contact with the upper web 48. Under these conditions, those portions of the webs 48 and 48' which overlie the feed dog members 46 are pressed in part between the feed dog member 46 and the lower surface portion of the first longitudinal rib 28 of the presser foot member 20 and in part between the feed dog member 46 and the outer peripheral surface of the annular band 38 which is pressed in part on the lower surface portion of the second longitudinal rib 30 of the presser foot member 20 and the surface defining the groove 32 in the presser foot member 20, as will be seen from FIG. 4. When the sewing machine is thereafter put into operation, the feed dog member 46 is driven for cyclic square motions below the overlapped webs 48 and 48' and concurrently the sewing needle 36 having a needle thread passed through the eye close to the pointed lower end of the needle is driven for alternately upward and downward motions through the needle hole 34 in the presser foot member 20 and through the webs 48 and 48' below the presser foot member 20. As the feed dog member 46 is thus driven for cyclic square motions underneath the webs 48 and 48' carried thereon, the webs 48 and 48' are intermittently fed forwardly or rearwardly on the throat plate of the sewing machine and urge the annular band 38 to move on the presser foot member 20 in the same direction as the direction in which the webs 48 and 48' are thus caused to travel on the throat plate. As a consequence, the annular band 38 as a whole is caused to move in a circumferential direction thereof with respect to the presser foot member 20 which is substantially held at rest throughout the sewing operation, horizontally sliding in part on the lower surface portion of the second longitudinal rib 30 of the presser foot member 20 and in part on the surface defining the elongated groove 32 in the presser foot member 20. Since, in this instance, the inner peripheral surface of the collar portion 40 and the surface defining the circumferential groove 40 in the annular band 38 are sufficiently smooth, the annular band 38 is enabled to slide smoothly on the presser foot member 20 and is, for this reason, capable of moving with the webs 48 and 48' without being subjected to any appreciable resistance while pressing the webs 48 and 48' against the feed dog member 46 with an adequate force. As the annular band 38 is being caused to slide on the presser foot member 22, the second longitudinal rib 30 of the presser foot member 20 slides in the circumferential groove 40 in the annular band 38 and guides the band 38 to move correctly on the presser foot member 20 and with the webs 48 and 48' being sewn together. The webs 48 and 48' contacted by the annular band 38 thus sliding on the presser foot member 20 are therefore permitted to travel smoothly between the presser foot member 20 and the feed dog member 46 and are precluded from being caused to slip on each other. While, furthermore, the annular band 38 is being moved with the webs 48 and 48' on the feed dog member 46, the lower surface portion of the first longitudinal rib 28 of the presser foot member 20 is held in pressing contact with or at least located in close proximity to the upper web 48 and prevents the webs 48 and 48' from being raised over the feed dog members 46. When the presser bar (not shown) is moved upwardly upon completion of the stitching of the webs 48 and 48', the presser foot assembly is also moved upwardly over the webs 48 and 48' so that the presser foot member 20 and the annular band 38 are disengaged from the webs 48 and 48', allowing the webs to be removed from the throat plate (not shown) of the sewing machine.

While the engagement between the presser foot member 20 and the annular band 38 is provided by the second longitudinal rib 30 on the presser foot member 20 and the circumferential groove 40 in the annular band 38 in the embodiment hereinbefore described with reference to FIGS. 1 to 4, it will be apparent that the engagement between the presser foot member and the annular band in a presser foot assembly according to the present invention may be provided by a circumferential rib formed on an inner peripheral wall of the annular band 38 and a groove formed in the presser foot member. Although, furthermore, the presser foot member 20 of the embodiment herein before described has been assumed to be of the type having the needle hole 34 formed adjacent one side end of the presser foot member 20, it will be apparent that the basic concept of the present invention can be realized not only in such a presser foot member but in a presser foot member having a needle hole located in a laterally middle portion of the presser foot member. In this instance, the presser foot member may have formed at the bottom thereof two side ribs extending along the opposite side ends of the presser foot member and a central rib extending in parallel with and between the two side ribs and laterally spaced apart inwardly from the side ribs for forming an elongated groove between the central rib and each of the two side ribs. Flexible annular bands each similar to the annular band illustrated in FIG. 3 are fitted to this presser foot member in such a manner that each of the annular bands has each of the two side ribs of the presser foot member slidably received in the circumferential groove formed in an inner peripheral wall of the annular band so that each annular band is slidable on the surface defining each of the elongated grooves formed between the central rib and the side ribs of the presser foot member.

Figure 5:
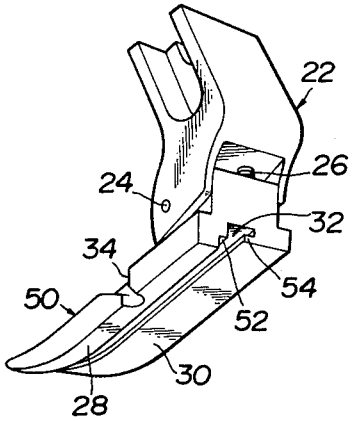
FIG. 5 is a perspective view showing part of another preferred embodiment of a presser foot assembly according to the present invention.

FIG. 5 shows a presser foot member which forms part of another preferred embodiment of a presser foot assembly according to the present invention. Similarly to the presser foot member 20 illustrated in FIG. 1, the presser foot member, now designated by 50 in FIG. 5, is pivotally connected to a bracket 22 by means of a pivot pin 24 with a helical compression spring 26 provided between the presser foot member 50 and the bracket 22 and has at its bottom first and second longitudinal ribs 28 and 30 respectively having substantially flat lower surface portions extending from the rearmost end of the presser foot member 50 toward the foremost end thereof, the lower surface portion of the first longitudinal rib 28 being lower than the lower surface portion of the second longitudinal rib 30. The ribs 28 and 30 and accordingly the respective lower surface portions thereof are spaced apart from each other and, thus, forms an elongated groove 32 having open longitudinal ends and defined by a flat surface higher than the respective lower surface portions of the first and second longitudinal ribs 28 and 30, as in the presser foot member 20 in the embodiment of FIGS. 1 to 4. The presser foot member 50 is further formed with a needle hole 34 which is located adjacent one side end of the presser foot member 50 and which is downwardly open through the first longitudinal rib 28.

Figure 6:
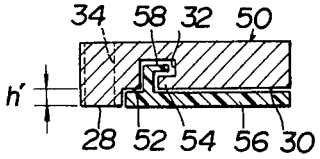
FIG. 6 is a cross sectional view showing the combination of the presser foot member illustrated in FIG. 5 and an annular band fitted to the presser foot member.

In the presser foot member 50 illustrated in FIG. 5, the first longitudinal rib 28 is adjacent to the elongated groove 32 across a stepped or ledged side wall 52, while the second longitudinal rib 30 has an inner side projection 54 longitudinally extending throughout the length of the rib 30 so that the elongated groove 32 between the ribs 28 and 30 has a generally inverted L-shaped cross section as will be seen more clearly from FIG. 6. The stepped or ledged side wall 52 of the presser foot member 50 has a flat lower surface portion which is substantially flush with the lower surface portion of the second longitudinal rib 30 across the elongated groove 32 in the presser foot member 50.

Figure 7:
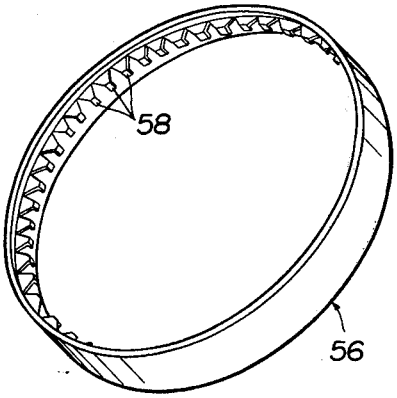
FIG. 7 is a perspective view showing the annular band which is shown in cross section in FIG. 6.
Figure 8A:
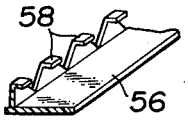
FIG. 8A is a perspective view showing, to an enlarged scale, a portion of the annular band illustrated in FIG. 7.
Figure 8B:
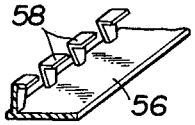
FIG. 8B is a view similar to FIG. 8B but shows a portion of an annular band having radial projections modified from those of the annular band illustrated in FIGS. 7 and 8A.

The presser foot assembly comprising the presser foot member 50 thus constructed and arranged further comprises a flexible and preferably elastic, annular band 56 having a series of radial projections 58 circumferentially arranged on and throughout the inner peripheral surface of the band 56 and located adjacent to and along one side end of the band 56 as shown in FIG. 7. As will be seen more clearly form FIG. 6, each of the radial projections 58 of the annular band 56 shown in FIG. 7 has a generally L-shaped cross sectional configuration substantially conforming to the cross sectional configuration of the elongated groove 32 in the presser foot member 50 illustrated in FIG. 5 and, thus, consists of a leg portion radially inwardly projecting from the inner peripheral surface of the annular band 54 and a lug portion which is perpendicularly bent from the leg portion in an axial direction of the annular band 56. In this instance, the leg portion of each of the radial projections 58 may be reduced in width toward the lug portion circumferentially of the annular band 56 as shown in FIG. 7 or more clearly in FIGS. 8A or, on the contrary, may be enlarged in width toward the lug portion circumferentially of the annular band 56 as shown in FIG. 8B.

The annular band 56 thus configured is assembled to the presser foot member 50 shown in FIG. 5 in such a manner as to have its inner peripheral surface slidably received in part on the lower surface portion of the second longitudinal rib 30 and in part on the lower surface portion of the stepped or ledged side wall 52 of the first longitudinal rib 28 and its radial projections 58 slidable through the elongated groove 32 in the presser foot member 50 as will be seen from FIG. 6. The flexible annular band 56 is, thus, circumferentially slidable on the presser foot member 50 through the surface-to-surface contact of the band 56 with the respective lower surface portions of the second longitudinal rib 30 and the stepped or ledged wall 52 of the first longitudinal rib 28. The annular band 56 has a thickness substantially equal to the height h' (FIG. 6) of the first longitudinal rib 28 with respect to the respective lower surface portions of the second longitudinal rib 30 and the stepped or ledged wall 52 of the first longitudinal rib 28. Thus, the outer peripheral surface of the annular band 56 becomes substantially flush with the lower surface portion of the first longitudinal rib 28 of the presser foot member 50 when the annular band 56 is held in close contact with the respective lower surface portions of the second longitudinal rib 30 and the stepped or ledged wall 52 of the first longitudinal rib 28 as will be seen from FIG. 6.

The annular band 56 shown in FIG. 7 may be formed of polypropyrene or any other synthetic resin having a relatively low friction coefficient and, if desired, may be covered with a suitable frictional layer such as for example a web of leather or relatively thick textile fabric applied to the outer peripheral surface of the band 56 similarly to the annular band 38 illustrated in FIG. 3.

Figure 9:
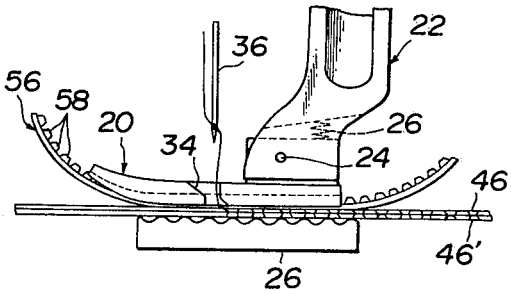
FIG. 9 is a side elevation view showing a condition in which the presser foot assembly including the presser foot member and the annular band illustrated in FIGS. 5 to 7 is in operation in a sewing machine.

When, now, the presser bar (not shown) connected by the bracket 22 to the presser foot member 50 thus constructed and arranged with the annular band 56 fitted thereto is moved downwardly with the webs of, for example, textile superposed on each other on the throat plate of the sewing machine, the presser foot member 50 is also moved downwardly into pressing contact with the upper one of the webs as shown in FIG. 9 in which the upper and lower webs are indicated at 48 and 48', respectively. Under these conditions, those portions of the webs 48 and 48' which lie underneath the presser foot member 50 are pressed in part between the feed dog member 46 and the lower surface portion of the first longitudinal rib 28 of the presser foot member 50 and in part between the feed dog member 46 and the outer peripheral surface of the annular band 56 intervening between the presser foot member 50 and the upper web 48. When the sewing machine is then put into operation driving the feed dog member 46 for cyclic square motions below the webs 48 and 48' and the sewing needle 36 for alternately upward and downward motions through the needle hole 34 in the presser foot member 50, the webs 48 and 48' are intermittently fed forwardly or rearwardly underneath the presser foot member 50 and urge the annular band 56 to move on the presser foot member 50 in the same direction as the direction in which the webs 48 and 48' are thus caused to advance on the throat plate of the sewing machine. This causes the annular band 56 to slide forwardly or rearwardly on the respective lower surface portions of the second longitudinal rib 30 and the stepped or ledged wall 52 of the first longitudinal rib 28 of the presser foot member 50 and accordingly to move in its entirety in a circumferential direction thereof with respect to the presser foot member 50 which is substantially held at rest throughout the sewing operation. As the annular band 56 is being thus caused to slide on the presser foot member 50, the radial projections 58 on the inner peripheral surface of the band 56 are successively admitted into and withdrawn from the elongated groove 32 in the presser foot member 50 and guide the annular band 56 to move accurately on the presser foot member 50 and the webs 48 and 48' being sewn together. Because, furthermore, of the fact that the inner peripheral surface of the annular band 56 and the respective lower surface portions of the second longitudinal rib 30 and the stepped or ledged wall 52 of the first longitudinal rib 28 of the presser foot member 50 are sufficiently smooth, the annular band 56 is enabled to slide smoothly on the presser foot member 50 and is capable of moving with the webs 48 and 48' without being subjected to any appreciable resistance while pressing the webs 48 and 48' against the feed dog member 46 with an adequate force. The webs 48 and 48' contacted by the annular band 56 thus sliding on the presser foot member 50 are therefore permitted to travel smoothly between the presser foot member 50 and the feed dog member 46 and are precluded from being caused to slip on each other.

Figure 10A:
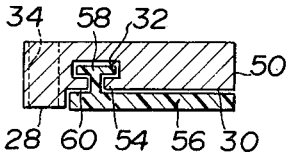
FIG. 10A is a cross sectional view showing the combination of a modification of the presser foot member illustrated in FIG. 5 and an annular band adapted to suit the modified presser foot member.
Figure 11A:
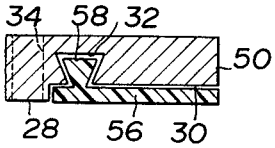
FIG. 11A is a cross sectional view showing the combination of another modification of the presser foot member illustrated in FIG. 5 and an annular band adapted to suit the particular presser foot member.
Figure 10B:
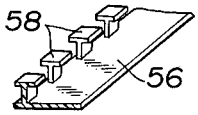
FIG. 10B is a perspective view showing a portion of the annular band illustrated in cross section in FIG. 10A.
Figure 11B:
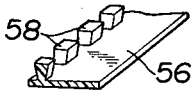
FIG. 11B is a perspective view showing a portion of the annular band illustrated in FIG. 11A.
Figure 12A:
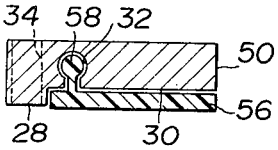
FIG. 12A is a cross sectional view showing the combination of still another modification of the presser foot member illustrated in FIG. 5 and an annular band adapted to suit the presser foot member thus modified.
Figure 12B:
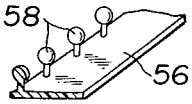
FIGS. 12B and 12C are perspective views showing examples of the annular band illustrated in cross section in FIG. 12A.
Figure 12C:
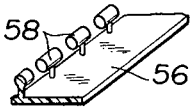

The presser foot member 50 and the annular band 56 of the embodiment of the presser foot assembly hereinbefore described with reference to FIGS. 5 to 9 may be modified in numerous manners if desired. For example, not only the second longitudinal rib 30 but the first longitudinal rib 28 or, more specifically, the stepped or ledged wall 52 of the first longitudinal rib 28 may be formed with an inner side projection as indicated at 60 in FIG. 10A. The respective side projections 60 and 54 of the first and second longitudinal ribs 28 and 30 of the presser foot member 50 longitudinally extend substantially in parallel with each other throughout the lengths of the ribs 28 and 30 and laterally project toward each other across the elongated groove 32 in the presser foot member 50 so that the groove 32 has a generally T-shaped cross section as shown in FIG. 6. The annular band 56 compatible with the presser foot member 50' thus modified is modified in such a manner that each of the radial projections 58 on the inner peripheral surface thereof has a generally T-shaped cross sectional configuration consisting of a leg portion radially inwardly projecting from the inner peripheral surface of the band and a lug portion projecting from the leading end of the leg portion in opposite axial directions of the annular band 56 as shown in FIG. 10B. As an alternative to the modification of the presser foot member illustrated in FIG. 10A, the presser foot member 50 generally constructed as shown in FIGS. 5 and 6 may be modified so that the elongated groove 32 formed between the first and second longitudinal ribs 28 and 30 has a generally dovetailed configuration which is reduced in width toward its open end as shown in FIG. 11A. In this instance, the annular band 56 generally configured as illustrated in FIG. 7 is modified in such a manner that each of the radial projections 58 thereof also has a dovetailed cross sectional configuration which is enlarged toward its end opposite to the inner peripheral surface of the band 56 as shown in FIG. 11B. Further alternatively, the presser foot member 50 having the general construction illustrated in FIGS. 5 and 6 may be modified so that the elongated groove 32 formed between the first and second longitudinal ribs 28 and 30 has a cross sectional configuration having a circular upper portion as shown in FIG. 12A. In this instance, the annular band 56 having the general configuration illustrated in FIG. 7 may be modified in such a manner that each of the radial projections 58 has a bar-shaped leg portion projecting radially inwardly from the inner peripheral surface of the annular band 56 and a spherical lug portion formed at the leading end of the leg portion as shown in FIG. 12B or has a bar-shaped leg portion projecting radially inwardly from the inner peripheral surface of the annular band 56 and a generally cylindrical lug portion formed at the leading end of the leg portion and having a center axis in a circumferential direction of the annular band 56 as shown in FIGS. 12C. The various examples of the respective cross sectional configurations of the elongated groove 32 in the presser foot member 50 and the radial projections 58 of the annular band 56 as hereinbefore described are simply for the purpose of illustration and may therefore be modified and varied in numerous manners if desired, insofar as the groove 32 in the presser foot member 50 is reduced in width toward its lower open end and each of the radial projections 58 of the annular band 56 has a cross sectional configuration substantially conforming to the cross sectional configuration of the groove 32 in the presser foot member 50 and permitting the radial projections 58 to be slidably received in the groove 32.

Figure 13:
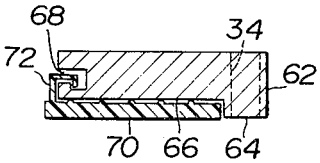
FIG. 13 is a cross sectional view showing the combination of the presser foot member and the annular band included in still another preferred embodiment of the present invention.

The elongated groove to provide slidable engagement between the presser foot member and the annular band forming part of a presser foot assembly according to the present invention has been assumed to be formed in the annular band 38 shown in FIG. 3 or between the first and second longitudinal rib portions 28 and 30 in the presser foot member 50 shown in FIGS. 5 and 6 or FIGS. 10A, 11A or 12A. If desired, however, the slidable engagement between the presser foot member and the annular band of a presser foot assembly according to the present invention may be formed in a side wall of the presser foot member. FIG. 13 shows part of an embodiment of the presser foot assembly thus arraged.

Referring to FIG. 13, such an embodiment of the presser foot assembly according to the present invention is shown comprising a presser foot member 62 having at the bottom thereof an elongated rib 64 extending longitudinally along one side end of the presser foot member 62 from the rearmost end of the presser foot member 62 toward the foremost end thereof and leaving a flat lower surface portion 66 adjacent to the inner side end of the rib 64. The presser foot member 62 is formed with a needle hole 34 which is downwardly open through the rib 64 thus formed alongside one lateral end of the presser foot member 62 as indicated by broken lines. The presser foot member 62 has further formed in its side wall portion opposite to the rib 64 an elongated groove 68 having open longitudinal ends and sidewise open throughout its length. The presser foot member 62 thus formed with the elongated groove 68 in its side wall portion opposite to the rib 64 has two lateral projections which are vertically spaced apart substantially in parallel from each other across the groove 68. The lower lateral projection defining the lower end of the groove 68 has an upward protrusion slightly protruding upwardly into the groove 68 along the lateral end of the projection as illustrated.

To the presser foot member 62 thus configured is fitted a flexible and preferably elastic, annular band 70 having a series of radial projections 72 circumferentially arranged on and throughout the inner peripheral surface of the band 70. Each of the radial projections 70 thus formed on the inner peripheral surface of the annular band 70 has a generally L-shaped cross sectional configuration and, thus, consists of a leg portion radially inwardly projecting from the inner peripheral surface of the annular band 70, a bent portion laterally inwardly bent from the leading end of the leg portion, and an end portion slightly bent downwardly from the leading end of the bent portion.

The annular band 70 having the radial projections 72 thus configured is fitted to the presser foot member 62 in such a manner that the inner peripheral surface of the annular band 70 is in slidable contact with the lower surface portion 66 of the presser foot member 62 and the radial projections 72 are slidable through the elongated groove 68 in the presser foot member 62 as shown in FIG. 13. The flexible annular band 70 is, thus, circumferentially slidable in part on the lower surface portion 66 of the pressure foot member 62 and in part in the elongated groove 68 in the presser foot member 62. The annular band 70 has a thickness substantially equal to the height of the rib 64 of the presser foot member 62 with respect to the lower surface portion 66 of the presser foot member 62 so that the outer peripheral surface of the annular band 70 is made substantially flush with the lower surface portion of the rib 64 when the annular band 70 is in close contact with the lower surface portion 66 of the presser foot member 62.

The radial projections 72 of the annular band 70 in the arrangement illustrated in FIG. 13 as well as the radial projections 58 of the annular band 56 shown in FIG. 7 and the various modified versions of the radial projections 56 as hereinbefore described have been assumed to be arranged at suitable, preferably regular intervals on the inner peripheral surface of the band 56 or 72. It will be, however, apparent that the annular band for use with the presser foot member 50 shown in FIG. 5 or the presser foot member 62 shown in FIG. 13 may have a single, continuous projection circumferentially extending on and throughout the inner peripheral surface of the annular band.

Figure 14:
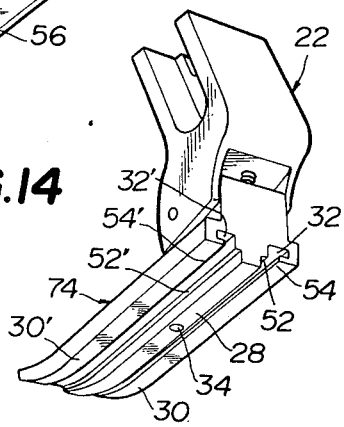
FIG. 14 is a perspective view showing part of still another preferred embodiment of the present invention.

While, furthermore, the presser foot member included in each of the embodiments of the present invention as hereinbefore described has been assumed to be of the type having the needle hole formed adjacent one side end of the presser foot member, it will be apparent that the features of the present invention can be achieved not only in a presser foot member of such a type but in a presser foot member having the needle hole in a laterally middle portion of the presser foot member. FIG. 14 shows an embodiment of the present invention applied to a presser foot member of this type.

Referring to FIG. 14, the presser foot member, now generally designated by reference numeral 74, has formed at the bottom thereof two side ribs 30 and 30′ extending longitudinally along the opposite side ends of the presser foot member 74 and spaced apart substantially in parallel from each other in a lateral direction of the pressor foot member 74, and a central rib 28 longitudinally extending in parallel with and between the side ribs 30 and 30′. The presser foot member 74 is formed with a needle hole 34 which is downwardly open through the central rib 28 and further with two elongated grooves 32 and 32′ which are provided respectively between the central rib 28 and one side rib 30 and between the central rib 28 and the other side rib 30′. Each of the elongated grooves 32 and 32′ has a cross sectional configuration similar to the cross sectional configuration of the elongated groove 32 formed in the presser foot member 50 illustrated in FIG. 5 and is therefore adapted to be engaged by a flexible annular band similar to the annular band 56 illustrated in FIG. 7 or any variation or modification of the band 56.

To the outer peripheral surface of the annular band forming part of each of the embodiments of the present invention as hereinbefore described may be applied a frictional layer of, for example, not only a web of leather or relatively thick textile fabric as previously discussed but a web having a brushy external surface especially when the sewing machine is to be used for the sewing of piled, napped or otherwise fluffy materials. As an alternative, the friction coefficient of the outer peripheral surface of the annular band in each of the embodiments according to the present invention may be reduced by spraying liquid silicone resin onto the outer peripheral surface of the annular band.

While, furthermore, it has been assumed that the present invention is embodied in a presser foot assembly of the hinged type having the pressor foot member pivotally connected to the bracket by means of a pivot pin, it will be apparent that the present invention is also applicable to a presser foot assembly of the fixed type wherein the presser foot member and the bracket are fixedly connected together or constructed as a unitary member.

What is claimed is:

1. A presser foot assembly of a sewing machine, comprising, in combination, a presser foot member having a substantially flat bottom surface extending in a fore-and-aft direction of the presser foot member and a bottom rib longitudinally extending adjacent said bottom surface, the presser foot member being formed with a needle hole which is downwardly open through said rib, and a flexible annular band having a smooth inner peripheral surface circumferentially slidable on said bottom surface in said fore-and-aft direction, one of the presser foot member and the annular band being formed with a groove extending at least in part in parallel with said fore-and-aft direction and the other of the presser foot member and the annular band being formed with a projection slidably received in said groove.

2. A presser foot assembly as set forth in claim 1, in which said annular band has formed as said groove a circumferential groove extending along the inner peripheral surface of the band and in which said presser foot member has a first longitudinal rib constituting said bottom rib and a second longitudinal rib extending along one side end of the presser foot member and laterally spaced substantially in parallel apart from said first longitudinal rib for forming between the first and second longitudinal ribs an elongated groove having open longitudinal ends and an upper end defined by said bottom surface, said second longitudinal rib constituting said projection and being slidable in said circumferential groove in said fore-and-aft direction of the presser foot member.

3. A presser foot assembly as set forth in claim 2, in which said second longitudinal rib of the presser foot member has a cross section enlarged downwardly away from said bottom surface defining the upper end of the groove between the first and second longitudinal ribs and in which said circumferential groove in said annular band has a cross section substantially conforming to said cross section of the second longitudinal rib of the presser foot member.

4. A presser foot assembly as set forth in claim 2, in which said second longitudinal rib has with respect to said bottom surface a height which is less than the height which said first longitudinal rib has with respect to said bottom surface.

5. A presser foot assembly as set forth in claim 4, in which said second longitudinal rib of the presser foot member has a cross section enlarged downwardly away from said bottom surface defining the upper end of the groove between the first and second longitudinal ribs and in which said circumferential groove in said annular band has a cross section substantially conforming to said cross section of the second longitudinal rib of the presser foot member.

6. A presser foot assembly as set forth in claim 5, in which said annular band has a thickness substantially equal to said height of said first longitudinal rib of the presser foot member.

7. A presser foot assembly as set forth in claim 6, in which said second longitudinal rib of the presser foot member has a cross section enlarged downwardly away from said bottom surface defining the upper end of the groove between the first and second longitudinal ribs and in which said circumferential groove in said annular band has a cross section substantially conforming to the cross section of the second longitudinal rib of the presser foot member.

8. A presser foot assembly as set forth in claim 1, in which said presser foot member has a first longitudinal rib constituting said bottom rib and a second longitudinal rib extending along one side end of the presser foot member and having a lower surface portion constituting said bottom surface, the first and second longitudinal ribs being spaced apart substantially in parallel from each other for forming said groove therebetween by an elongated groove having open longitudinal ends, said projection being formed on the inner peripheral surface of said annular band and being slidable through said elongated groove in said fore-and-aft direction of the presser foot member.

9. A presser foot assembly as set forth in claim 8, in which said projection is constituted by each of a series of radial projections formed on the inner peripheral surface of the annular band.

10. A presser foot assembly as set forth in claim 9, in which said radial projections are arranged at substantially regular intervals from each other circumferentially of the inner peripheral surface of the annular band.

11. A presser foot assembly as set forth in claim 9, in which said elongated groove in said presser foot member has a cross section enlarged upwardly from its open lower end and in which each of said radial projections has a cross section substantially conforming to the cross section of the elongated groove in the presser foot member.

12. A presser foot assembly as set forth in claim 11, in which the cross section of said elongated groove in the presser foot member is enlarged upwardly in one lateral direction of the presser foot member.

13. A presser foot assembly as set forth in claim 12, in which each of said radial projections has a leg portion projecting radially inwardly from the inner peripheral surface of the annular band and a lug portion which is bent from said leg portion in said lateral direction of the presser foot member.

14. A presser foot assembly as set forth in claim 11, in which the cross section of said elongated groove in the presser foot member is upwardly enlarged in opposite lateral directions of the presser foot member.

15. A presser foot assembly as set forth in claim 14, in which each of said radial projections has a leg portion projecting radially inwardly from the inner peripheral surface of said annular band and a lug portion projecting from the leading end of said leg portion in opposite axial directions of the annular band.

16. A presser foot assembly as set forth in claim 11, in which the cross section of said elongated groove in the presser foot member has a generally dovetailed configuration which is reduced in width toward the open lower end of the groove.

17. A presser foot assembly as set forth in claim 16, in which each of said radial projections has a generally dovetailed cross sectional configuration enlarged in width toward its end opposite to the inner peripheral surface of the annular band.

18. A presser foot assembly as set forth in claim 11, in which the cross section of said elongated groove in the presser foot member has a generally circular upper portion.

19. A presser foot assembly as set forth in claim 18, in which each of said radial projections has a bar-shaped leg portion projecting radially inwardly from the inner peripheral surface of said annular band and a generally spherical lug portion formed at the leading end of said leg portion.

20. A presser foot assembly as set forth in claim 19, in which each of said radial projections has a bar-shaped leg portion projecting radially inwardly from the inner peripheral surface of said annular band and a generally cylindrical lug portion having a center axis in a circumferential direction of the annular band and formed at the leading end of said leg portion.

21. A presser foot assembly as set forth in claim 9, in which said first longitudinal rib has a substantially flat lower surface portion lower than said lower surface portion of the second longitudinal rib.

22. A presser foot assembly as set forth in claim 21, in which said first longitudinal rib has a ledged side wall adjacent to said elongated groove in the presser foot member throughout the length of the first longitudinal rib.

23. A presser foot assembly as set forth in claim 22, in which said ledged side wall has a lower surface portion substantially flush with said lower surface portion of said second longitudinal rib across said elongated groove.

24. A presser foot assembly as set forth in claim 21, 22 or 23, in which said second longitudinal rib has an inner side projection laterally projecting into said elongated groove in said presser foot member throughout the length of the second longitudinal rib.

25. A presser foot assembly as set forth in claim 24, in which said radial projections are arranged at substantially regular intervals from each other circumferentially of the inner peripheral surface of the annular band.

26. A presser foot assembly as set forth in claim 25, in which said elongated groove in said presser foot member has a cross section enlarged upwardly from its open lower end and in which each of said radial projections has a cross section substantially conforming to the cross section of the elongated groove in the presser foot member.

27. A presser foot assembly as set forth in claim 26, in which the cross section of said elongated groove in the presser foot member is enlarged upwardly in one lateral direction of the presser foot member.

28. A presser foot assembly as set forth in claim 27, in which each of said radial projections has a leg portion projecting radially inwardly from the inner peripheral surface of the annular band and a lug portion which is bent from said leg portion in said lateral direction of the presser foot member.

29. A presser foot assembly as set forth in claim 26, in which the cross section of said elongated groove in the presser foot member is upwardly enlarged in opposite lateral directions of the presser foot member.

30. A presser foot assembly as set forth in claim 29, in which each of said radial projections has a leg portion projecting radially inwardly from the inner peripheral surface of said annular band and a lug portion projecting from the leading end of said leg portion in opposite axial directions of the annular band.

31. A presser foot assembly as set forth in claim 26, in which the cross section of said elongated groove has a generally dovetailed configuration which is reduced in width toward the open lower end of the groove.

32. A presser foot assembly as set forth in claim 31, in which each of said radial projections has a generally dovetailed cross sectional configuration enlarged in width toward its end opposite to the inner peripheral surface of the annular band.

33. A presser foot assembly as set forth in claim 26, in which the cross section of said elongated groove in the presser foot member has a generally circular upper portion.

34. A presser foot assembly as set forth in claim 33, in which each of said radial projections has a bar-shaped leg portion projecting radially inwardly from the inner peripheral surface of said annular band and a generally spherical lug portion formed at the leading end of said leg portion.

35. A presser foot assembly as set forth in claim 34, in which each of said radial projections has a bar-shaped leg portion projecting radially inwardly from the inner peripheral surface of said annular band and a generally cylindrical lug portion having a center axis in a circumferential direction of the annular band and formed at the leading end of said leg portion.

36. A presser foot assembly as set forth in claim 1, in which said groove is constituted by an elongated groove which said presser foot member has formed in its side wall opposite to said bottom rib across said bottom surface and which extends in said fore-and-aft direction of the presser foot member and has open longitudinal ends, said projection being formed adjacent one side end of the inner peripheral surface of said annular band and being slidable through said elongated groove in said presser foot member.

37. A presser foot assembly as set forth in claim 36, in which said projection is constituted by each of a series of radial projections formed on the inner peripheral surface of said annular band.

38. A presser foot assembly as set forth in claim 37, in which said radial projections are arranged at regular intervals substantially throughout the inner circumerence of said annular band.

39. A presser foot assembly as set forth in claim 37 or 38, in which each of said radial projections has a leg portion projecting radially inwardly from the inner peripheral surface of said annular band, and a bent portion laterally bent from the leading end of said leg portion and engageable with said presser foot member through said elongated groove in the presser foot member.

40. A presser foot assembly as set forth in claim 1 in which said annular band has a frictional layer attached to the outer peripheral surface of the band.

41. A presser foot assembly as set forth in claim 10, in which said frictional layer consists of a web of leather.

42. A presser foot assembly as set forth in claim 40, in which said frictional layer consists of a web of brushy material.

43. A presser foot assembly as set forth in claim 40, in which said frictional layer consists of a coating of silicone.

44. A presser foot assembly as set forth in claim 40, in which said frictional layer is formed of a web of a textile fabric.

* * * * *